US009575499B2

(12) United States Patent
Lee et al.

(10) Patent No.: US 9,575,499 B2
(45) Date of Patent: Feb. 21, 2017

(54) LOW-DROPOUT VOLTAGE REGULATOR

(71) Applicant: GREEN SOLUTION TECHNOLOGY CO., LTD., New Taipei (TW)

(72) Inventors: Li-Min Lee, New Taipei (TW); Zhong-Wei Liu, Wuxi (CN); Shian-Sung Shiu, New Taipei (TW); Ying-Ying Yang, Wuxi (CN)

(73) Assignee: GREEN SOLUTION TECHNOLOGY CO., LTD., New Taipei (TW)

( * ) Notice: Subject to any disclaimer, the term of this patent is extended or adjusted under 35 U.S.C. 154(b) by 27 days.

(21) Appl. No.: 14/803,133

(22) Filed: Jul. 20, 2015

(65) Prior Publication Data

US 2016/0048148 A1 Feb. 18, 2016

(30) Foreign Application Priority Data

Aug. 14, 2014 (CN) ..... 2014 1 0401577

(51) Int. Cl.
*G05F 1/575* (2006.01)

(52) U.S. Cl.
CPC ..... *G05F 1/575* (2013.01)

(58) Field of Classification Search
CPC ..... G05F 1/10; G05F 1/56; G05F 1/563; G05F 1/565; G05F 1/575; G05F 3/24; H02M 2001/007; H02M 2001/009; H02M 2001/0032; H02M 2001/0042; H02M 2001/0045; H02M 3/156–3/158; H02M 3/1584; H02M 3/1588; Y02B 70/1466
USPC ..... 323/265, 271–282
See application file for complete search history.

(56) References Cited

U.S. PATENT DOCUMENTS

| | | | |
|---|---|---|---|
| 5,939,867 | A | 8/1999 | Capici et al. |
| 6,157,176 | A | 12/2000 | Pulvirenti et al. |
| 6,522,111 | B2 | 2/2003 | Zadeh et al. |
| 2008/0218137 | A1 | 9/2008 | Okuyama et al. |

(Continued)

FOREIGN PATENT DOCUMENTS

| | | |
|---|---|---|
| CN | 101122804 | 2/2008 |
| CN | 101520668 | 9/2009 |

(Continued)

OTHER PUBLICATIONS

"Office Action of China Counterpart Application", issued on Jul. 25, 2016, p. 1-p. 8.

(Continued)

*Primary Examiner* — Yemane Mehari
(74) *Attorney, Agent, or Firm* — Jianq Chyun IP Office

(57) ABSTRACT

The invention is directed to a low-dropout voltage regulator (LDO), including a power transistor, a driving stage circuit, a feedback circuit, a bias power source and an auxiliary reference current generation circuit. The power transistor is controlled by a driving signal to convert an input voltage into an output voltage. The feedback circuit generates a feedback voltage according to the output voltage. The driving stage circuit generates the driving signal according to the feedback voltage and the reference voltage. The bias power source provides a bias current. The auxiliary reference current generation circuit is configured to sample an output current, adjust the sampled output current to generate an adjustment current by means of mapping and superpose the adjustment current onto the bias current to generate a reference current to control drive capability of the driving stage circuit.

13 Claims, 5 Drawing Sheets

(56) References Cited

U.S. PATENT DOCUMENTS

| | | | |
|---|---|---|---|
| 2008/0224675 | A1 | 9/2008 | Takagi |
| 2009/0128107 | A1 | 5/2009 | Wang et al. |
| 2009/0224737 | A1 | 9/2009 | Lou |
| 2010/0289472 | A1 | 11/2010 | Renous |
| 2010/0315158 | A1 | 12/2010 | Atrash et al. |
| 2011/0156686 | A1 | 6/2011 | Gakhar et al. |
| 2012/0299564 | A1 | 11/2012 | Howes et al. |
| 2013/0069607 | A1 | 3/2013 | Suzuki |
| 2013/0113447 | A1 | 5/2013 | Kadanka |
| 2013/0285631 | A1 | 10/2013 | Bisson et al. |
| 2013/0307506 | A1 | 11/2013 | Oh et al. |

FOREIGN PATENT DOCUMENTS

| | | |
|---|---|---|
| CN | 102945059 | 2/2013 |
| TW | 201033782 | 9/2010 |
| TW | 201217933 | 5/2012 |
| TW | 201225515 | 6/2012 |
| TW | 201401009 | 1/2014 |

OTHER PUBLICATIONS

"Office Action of Taiwan Counterpart Application", issued on Oct. 8, 2015, p. 1-p. 8.

LOW-DROPOUT VOLTAGE REGULATOR

CROSS-REFERENCE TO RELATED APPLICATION

This application claims the priority benefit of China application serial no. 201410401577.3, filed on Aug. 14, 2014. The entirety of the above-mentioned patent application is hereby incorporated by reference herein and made a part of this specification.

BACKGROUND

Field of the Invention

The invention is directed to a voltage regulator and more particularly, to a low-dropout voltage regulator (LDO).

Description of Related Art

In applications of electronic apparatuses, particularly portable electronic apparatuses, users have increasingly high demand for battery life. If overall static power consumption can be reduced, the usage duration of a portable electronic apparatus can be effectively prolonged. The static power consumption is majorly induced by a low-dropout voltage regulator (LDO) installed in the portable electronic apparatus; however, the static power consumption of a typical LDO cannot be adjusted along with an output current.

Under this premise, if it is considered to design the LDO in a large-current application, the static state power consumption of the LDO is usually maintained within a range from 0.5 mA to 2 mA, and in this way, the demand for a longer standby duration of the portable electronic apparatus cannot be satisfied. On the other hand, if hardware parameters of the LDO are adjusted to lower down the static state power consumption (e.g., down to about 0.1 mA), it may lead to an issue of worse load transient response characteristics. As a result, an unrecoverable failure may occur during the process that the system is switched from the standby state to the operation state.

SUMMARY

The invention provides a low-dropout voltage regulator (LDO) with low static power consumption and better load transient response characteristics.

According to an embodiment of the invention, an LDO including a power transistor, a driving stage circuit, a feedback circuit, a bias power source and an auxiliary reference current generation circuit is provided. The power transistor receives a driving signal for controlling its switching and converts an input voltage into an output voltage to provide to a load. The feedback circuit is coupled to the power transistor and generates a feedback voltage according to the output voltage. The driving stage circuit generates the driving signal according to the feedback voltage and the reference voltage. The bias power source is coupled to the driving stage circuit and configured to provide a bias current. The auxiliary reference current generation circuit is coupled to the power transistor, the driving stage circuit and the bias power source and configured to sample an output current flowing through the power transistor, adjust the sampled output current to generate an adjustment current by means of mapping and superpose the adjustment current onto the bias current to generate a reference current to control drive capability of the driving stage circuit.

Based on the above, in the embodiments of the invention, the LDO can sample the output current and superpose the adjustment current associated to the size of the output current onto the bias current by means of the mapping of the current mirror, so as to generate the reference current for controlling the drive capability of the driving stage circuit. In this way, the LDO of the invention can dynamically adjust the drive capability of the driving stage circuit according to the size of the output current, such that the LDO can have advantages of low static power consumption and better load transient response characteristics.

In order to make the aforementioned and other features and advantages of the invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
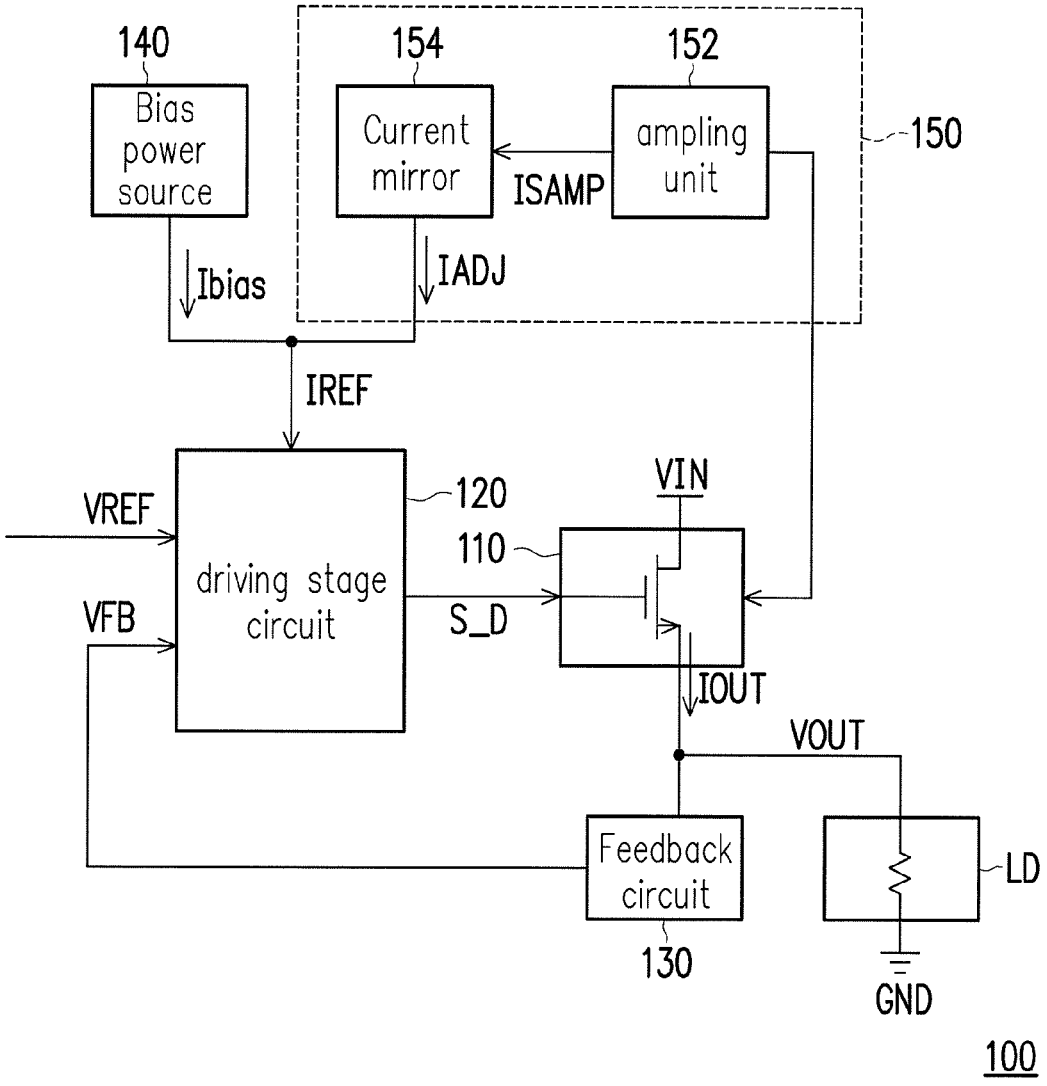
FIG. 1 is a schematic functional block diagram illustrating a low-dropout voltage regulator (LDO) according to an embodiment of the invention.

In order to make the disclosure more comprehensible, embodiments are described below as examples showing that the disclosure can actually be realized. Wherever possible, the same reference numbers are used in the drawings and the description to refer to the same or like parts.

FIG. 1 is a schematic functional block diagram illustrating a low-dropout voltage regulator (LDO) according to an embodiment of the invention. Referring to FIG. 1, in the present embodiment, an LDO 100 includes a power transistor 110, a driving stage circuit 120, a feedback circuit 130, a bias power source 140 and an auxiliary reference current generation circuit 150.

The power transistor 110 is, for example, an N-type transistor or a P-type transistor, receives a driving signal S_D from the driving stage circuit 120 and is controlled by the driving signal S_D to switch between on/off states, so as to convert an input voltage VIN into an output voltage VOUT to provide to a load LD for use.

The driving stage circuit 120 is configured to generate the driving signal S_D according to a feedback voltage VFB associated with the output voltage VOUT and a reference voltage VREF to drive the power transistor 110. The driving stage circuit 120 is formed by, for example, a plurality of operational amplifiers (whose circuit structure will be described), and drive capability of the operational amplifiers is typically determined based on operation power size. The driving stage circuit 120 of the present embodiment receives a reference current IREF from the external and generates a corresponding operation current based on a size of the reference current IREF. In other words, in the present embodiment, drive capability/current output capacity of the driving stage circuit 120 is determined according to the received reference current IREF.

The feedback circuit 130 is coupled to the load LD, the power transistor 110 and the driving stage circuit 120. The feedback circuit 130 may be configured to divide the output voltage VOUT, so as to generate a feedback voltage VFB to provide to the driving stage circuit 120. The bias power source 140 is coupled to the driving stage circuit 120 and may be configured to provide a fixed bias current Ibias which serves as a part of the reference current IREF to provide to the driving stage circuit 120.

The auxiliary reference current generation circuit 150 is coupled to the power transistor 110, the driving stage circuit 120 and the bias power source 140. The auxiliary reference current generation circuit 150 is configured to sample an output current IOUT flowing through the power transistor and adjust the obtained sampling current ISAMP to generate an adjustment current IADJ by means of mapping. The auxiliary reference current generation circuit 150 superposes the generated adjustment current IADJ onto the bias current Ibias to serve the superposed current as the reference current IREF to provide to the driving stage circuit 120.

Specifically, the auxiliary reference current generation circuit 150 includes a sampling unit 152 and a current mirror 154. The sampling unit 152 is coupled to the power transistor 110. The sampling unit 152 samples the output current IOUT in a first ratio, so as to generate the sampling current ISAMP. The current mirror 154 is coupled to the sampling unit 152 to map the sampling current ISAMP as the adjustment current IADJ in a second ratio. Therein, the current mirror 154 superposes the adjustment current IADJ onto the bias current Ibias provided by the bias power source 140 and serves the superposed current as the reference current IREF to provide to the driving stage circuit 120.

In other words, in the present embodiment, the sampling current ISAMP and the output current IOUT has the first ratio, while the sampling current ISAMP and the adjustment current IADJ has the second ratio. For example, the first ratio may be, for example, 1:10000 (i.e., the sampling current ISAMP is 1/10000 the output current IOUT), while the second ratio may be, for example, 10:1 (i.e., the adjustment current IADJ is 1/10 the sampling current ISAMP), but the invention is not limited thereto. The selection of the ratios may vary according to circuit designs, and thus, any circuit design capable of sampling the output current IOUT, mapping and superposing to generate the reference current IREF to provide to the driving stage circuit 120 does not depart from the scope of the invention.

In the present embodiment, when the load LD is operated in a pending state, the auxiliary reference current generation circuit 150 generates an adjustment current IADJ with a current size about 0 μA (which is not limited in the invention) according to the output current IOUT and superposes the adjustment current IADJ onto the bias current Ibias (with a size of 1 μA, for example, but the invention is not limited thereto) to serve as the reference current IREF to provide to the driving stage circuit 120, such that the driving stage circuit 120 generates a corresponding driving current according to the reference current IREF for driving the circuits. When the load LD is operated in a normal operation state, the auxiliary reference current generation circuit 150 generates an adjustment current IADJ (which is typically greater than 10 μA) according to the output current IOUT, where a current size of the adjustment current IADJ depends on whether the load LD is in a light or a heavy load state. The auxiliary reference current generation circuit 150 superposes the adjustment current IADJ onto the bias current Ibias to serve as the reference current IREF to provide to the driving stage circuit 120, such that the driving stage circuit 120 generates another driving current (with a size greater than the driving current in the pending state) according to the reference current IREF for driving the circuit.

To be more specific, since the reference current IREF for determining the drive capability of the driving stage circuit 120 is dynamically and correspondingly adjusted according to the size of the output current IOUT (i.e., whether the load LD is in the light or the heavy state), the LDO 100 of the present embodiment may induce the driving stage circuit 120 to generate the driving signal S_D by using a lower drive capability when the load LD is operated in the pending/light load state, so as to reduce static state power consumption. On the other hand, when the load is operated in the normal operation state, the driving stage circuit 120 may correspondingly increase the drive capability according to the received reference current IREF, so as to prevent failure occurring during a system state transfer from the pending state to the normal operation state due to the load having bad transient response characteristics.

The structure of the LDO of the invention will be specifically described according to a first through an eighth embodiments illustrated with reference to FIG. 2 through FIG. 9. Therein, FIG. 2 through FIG. 5 illustrate exemplary examples where an N-type transistor serves as the power transistor, and FIG. 6 through FIG. 9 illustrate exemplary examples where a P-type transistor serves as a power transistor.

Figure 2:
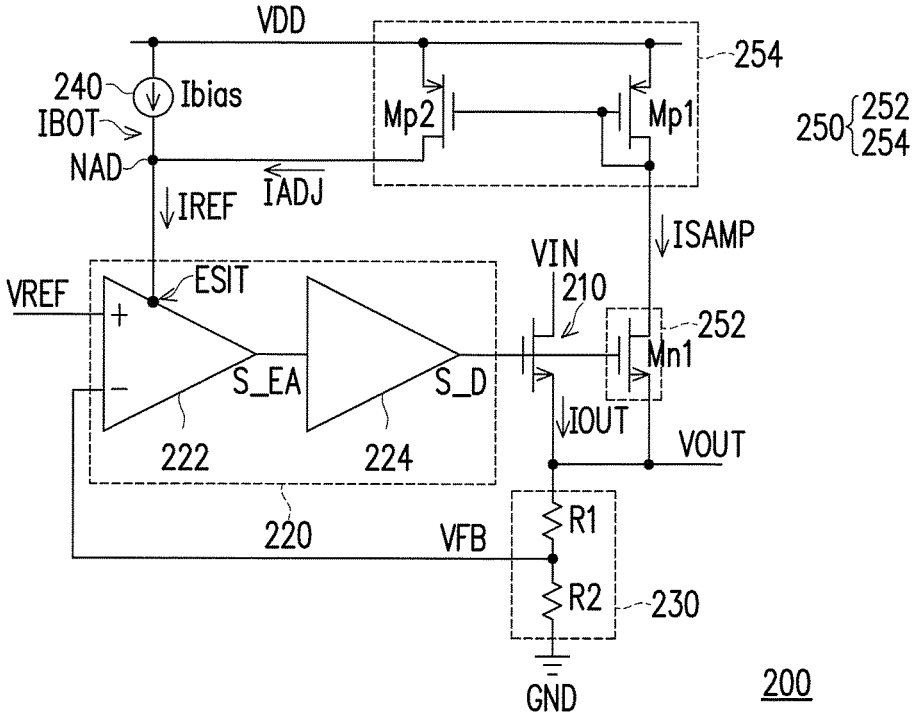
FIG. 2 is a schematic structural diagram illustrating an LDO according to the first embodiment of the invention.

FIG. 2 is a schematic structural diagram illustrating an LDO according to the first embodiment of the invention. Referring to FIG. 2, in the present embodiment, an LDO 200 includes a power transistor 210, a driving stage circuit 220, a feedback circuit 230, a bias power source 240 and an auxiliary reference current generation circuit 250. The driving stage circuit 220 includes an error amplifier 222 and an output buffer 224. The feedback circuit 230 includes resistors R1 and R2. The auxiliary reference current generation circuit 250 includes a sampling unit 252 and a current mirror 254.

The power transistor 210 of the present embodiment is an N-type transistor. A gate of the power transistor 210 is coupled to an output terminal of the output buffer 224. A drain of the power transistor 210 receives an input voltage VIN, and a source of the power transistor 210 is coupled to a load (which is not shown, but may be for example, the load LD) to provide an output voltage VOUT.

In the driving stage circuit 220, a positive input terminal of the error amplifier 222 receives the reference voltage VREF, and a negative input terminal of the error amplifier 222 is coupled to the feedback circuit 230 to receive the feedback voltage VFB. The error amplifier 222 compares the reference voltage VREF with the feedback voltage VFB and generates an error amplification signal S_EA according to the comparison result. An input terminal of the output buffer 224 is coupled to an output terminal of the error amplifier 222. The output terminal of the output buffer 224 generates the driving signal S_D according to the error amplification signal S_EA output by the error amplifier 222 and provides the driving signal S_D to the gate of the power transistor 210.

The feedback circuit 230 may be implemented by using the resistors R1 and R2 connected in serial. A first terminal of the resistor R1 is coupled to the source of the power transistor 210, a second terminal of the resistor R1 is coupled to a first terminal of the resistor R2, and a second terminal of the resistor R2 is coupled to a ground terminal GND. Besides, a common node/voltage-dividing node between the resistors R1 and R2 is coupled to the negative input terminal of the error amplifier 222 to provide the feedback voltage VFB.

In the auxiliary reference current generation circuit 250, the sampling unit 252 may be implemented by using, for example, an N-type transistor Mn1, while the current mirror 254 may be implemented by using, for example, P-type transistors Mp1 and Mp2, but the invention is not limited thereto. A gate of the N-type transistor Mn1 is coupled to the gate of the power transistor 210, and a source of the N-type transistor Mn1 is coupled to the source of the power transistor 210. A gate and a drain of the P-type transistor Mp1 are jointly coupled to a drain of the N-type transistor Mn1, and a source of the P-type transistor Mp1 receives a positive power supply voltage VDD (the positive power supply voltage VDD referred herein may be the input voltage VIN or an independent voltage, but the invention is not limited thereto). A gate of the P-type transistor Mp2 is coupled to the gate of the P-type transistor Mp1. A drain of the P-type transistor Mp2 is coupled to an outflow end IBOT of the bias current of the bias power source 240 and an inflow end ESIT of the reference current of the error amplifier 222, and a source of the P-type transistor Mp2 receives the positive power supply voltage VDD.

In detail, in the configuration of the N-type transistor Mn1, the N-type transistor Mn1 and the power transistor 210 have the same gate-source voltage (Vgs), and thus, a drain-source current (Ids) created between the N-type transistor Mn1 and the power transistor 210 is proportional to a size (W/L) of the transistor. In other words, as long as the size of the N-type transistor Mn1 is adaptively selected, the output current IOUT may be sampled in a ratio associated with the transistor size, so as to generate the sampling current ISAMP.

On the other hand, in the current mirror 254, the sampling current ISAMP flowing through the P-type transistor Mp1 is mapped to a current path of the P-type transistor Mp2 according to a fixed ratio (which is determined according to the sizes of the P-type transistors Mp1 and Mp2) to serve as the adjustment current IADJ. The bias current Ibias and the adjustment current IADJ are superposed together on a node NAD to serves as the reference current IREF. The reference current IREF then serves as a sink current of the error amplifier 222 and is provided to the error amplifier 222 from the inflow end ESIT of the reference current of the error amplifier 222.

Thus, in the present embodiment, drive capability of the error amplifier 222 is adjusted with the size of the reference current IREF, and drive capability of the output buffer 224 maintains fixed.

Figure 3:
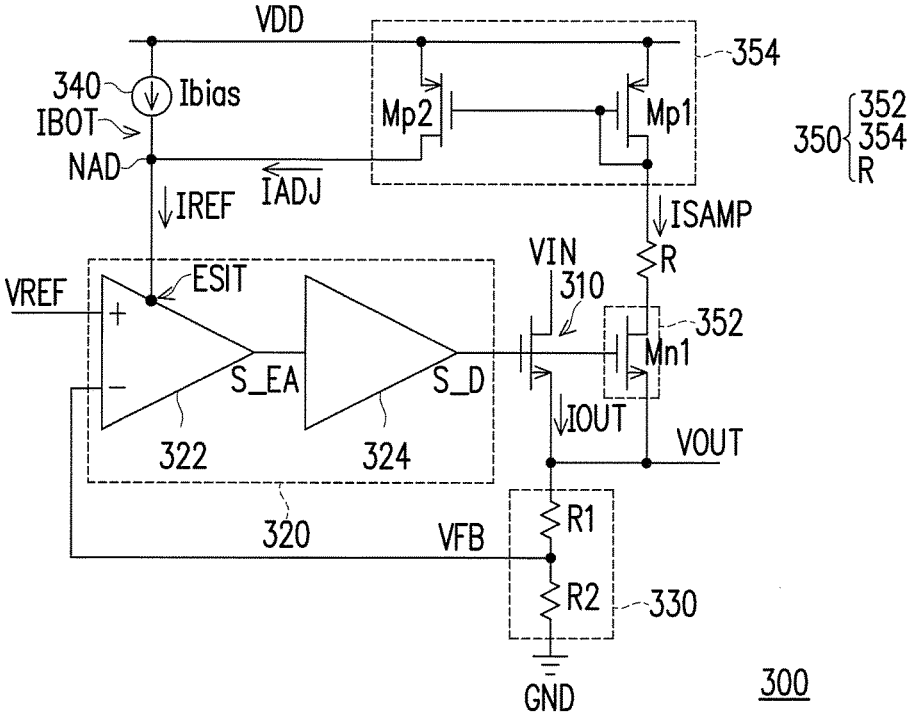
FIG. 3 is a schematic structural diagram illustrating an LDO according to the second embodiment of the invention.

FIG. 3 is a schematic structural diagram illustrating an LDO according to the second embodiment of the invention. Referring to FIG. 3, in the present embodiment, an LDO 300 includes a power transistor 310, a driving stage circuit 320, a feedback circuit 330, a bias power source 340 and an auxiliary reference current generation circuit 350. The driving stage circuit 320 includes an error amplifier 322 and an output buffer 324. The feedback circuit 330 includes the resistors R1 and R2. The auxiliary reference current generation circuit 350 includes a sampling unit 352, a current mirror 354 and a resistors R.

The circuit structure and the operation of the LDO 300 of the second embodiment are substantially the same as the LDO 200 of the first embodiment, and the difference therebetween lies in the auxiliary reference current generation circuit 350 of the present embodiment further including the resistor R. In detail, the resistor R is connected in serial between the N-type transistor Mn1 and the P-type transistor Mp1 and configured to decay/limit the size of the sampling current ISAMP, such that when the output current IOUT is too large, unnecessary power waste due to the adjustment current IADJ with an overly large size superposed on the bias current Ibias can be prevented.

Figure 4:
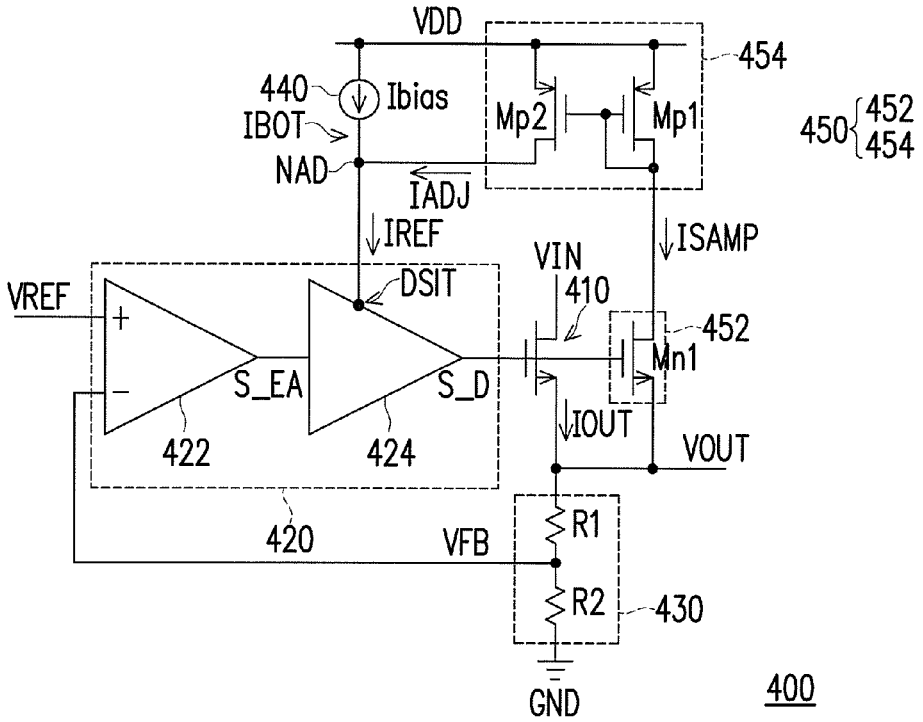
FIG. 4 is a schematic structural diagram illustrating an LDO according to the third embodiment of the invention.

FIG. 4 is a schematic structural diagram illustrating an LDO according to the third embodiment of the invention. Referring to FIG. 4, in the present embodiment, an LDO 400 includes a power transistor 410, a driving stage circuit 420, a feedback circuit 430, a bias power source 440 and an auxiliary reference current generation circuit 450. The driving stage circuit 420 includes an error amplifier 422 and an output buffer 424. The feedback circuit 430 includes the resistors R1 and R2. The auxiliary reference current generation circuit 450 includes a sampling unit 452 and a current mirror 454. The structure of the LDO 400 of the third embodiment is substantially the same as the LDO 200 of the first embodiment, and the difference therebetween lies in the auxiliary reference current generation circuit 450 of the present embodiment providing the reference current IREF to the output buffer 424, so as to adjust drive capability of the output buffer 424.

In detail, the gate of the N-type transistor Mn1 is coupled to a gate of the power transistor 410, and the source of the N-type transistor Mn1 is coupled to a source of the power transistor 410. The gate and the drain of the P-type transistor Mp1 are jointly coupled to the drain of the N-type transistor Mn1, and the source of the P-type transistor Mp1 receives the positive power supply voltage VDD. The gate of the P-type transistor Mp2 is coupled to the gate of the P-type transistor Mp1. The drain of the P-type transistor Mp2 is coupled to an outflow end IBOT of the bias current of the bias power source 440 and an inflow end DSIT of the reference current of the output buffer 424, and the source of the P-type transistor Mp2 receives the positive power supply voltage VDD.

In the current mirror 454, the sampling current ISAMP flowing through the P-type transistor Mp1 is mapped to the current path of the P-type transistor Mp2 according to a fixed ratio to serve as the adjustment current IADJ. The bias current Ibias and the adjustment current IADJ are superposed together on the node NAD to serves as the reference current IREF. The reference current IREF serves as a sink current of the output buffer 424 and is provided to the output buffer 424 from the inflow end DSIT of the reference current of the output buffer 424.

Thus, in the present embodiment, drive capability of the output buffer 424 is adjusted with the size of the reference current IREF, and drive capability of the error amplifier 422 maintains fixed.

Figure 5:
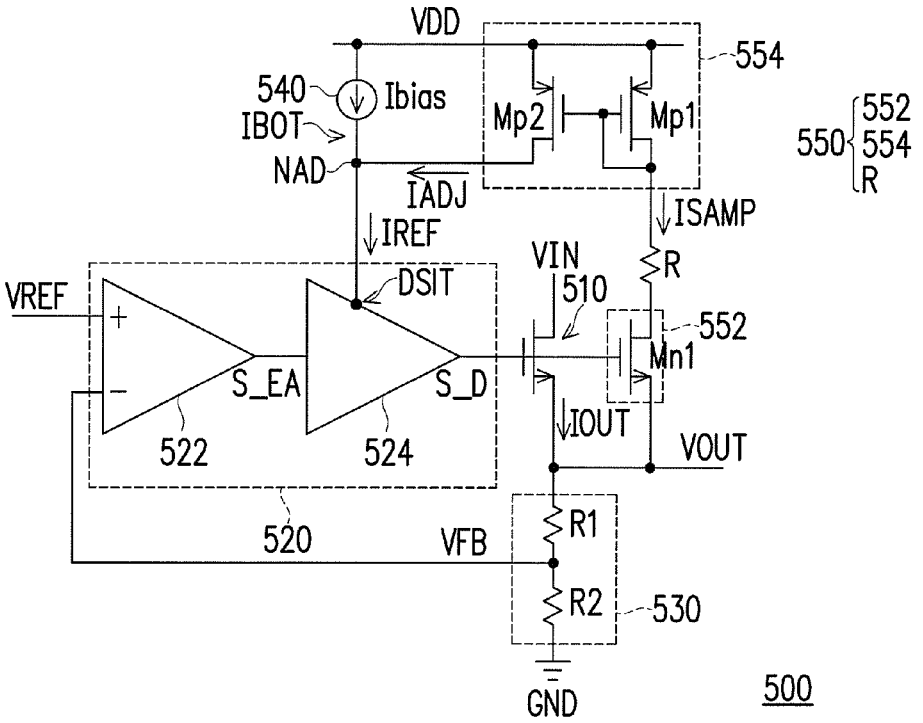
FIG. 5 is a schematic structural diagram illustrating an LDO according to the fourth embodiment of the invention.

FIG. 5 is a schematic structural diagram illustrating an LDO according to the fourth embodiment of the invention. Referring to FIG. 5 in the present embodiment, an LDO 500 includes a power transistor 510, a driving stage circuit 520, a feedback circuit 530, a bias power source 540 and an auxiliary reference current generation circuit 550. The driving stage circuit 520 includes an error amplifier 522 and an output buffer 524. The feedback circuit 530 includes the resistors R1 and R2. The auxiliary reference current generation circuit 550 includes a sampling unit 552, a current mirror 554 and the resistor R.

The circuit structure and the operation of the LDO 500 of the fourth embodiment are substantially the same as the LDO 400 of the third embodiment, and the difference therebetween lies in auxiliary reference current generation circuit 550 of the present embodiment further including the resistor R. In detail, the resistor R is connected in serial between the N-type transistor Mn1 and the P-type transistor Mp1 and configured to decay/limit the size of the sampling current ISAMP, such that when the output current IOUT is too large, unnecessary power waste due to the adjustment current IADJ with an overly large size superposed on the bias current Ibias can be prevented.

Hereinafter, the fifth through the eighth embodiments illustrated in FIG. 6 through FIG. 9 are exemplary examples where a P-type transistor serves as a power transistor.

Figure 6:
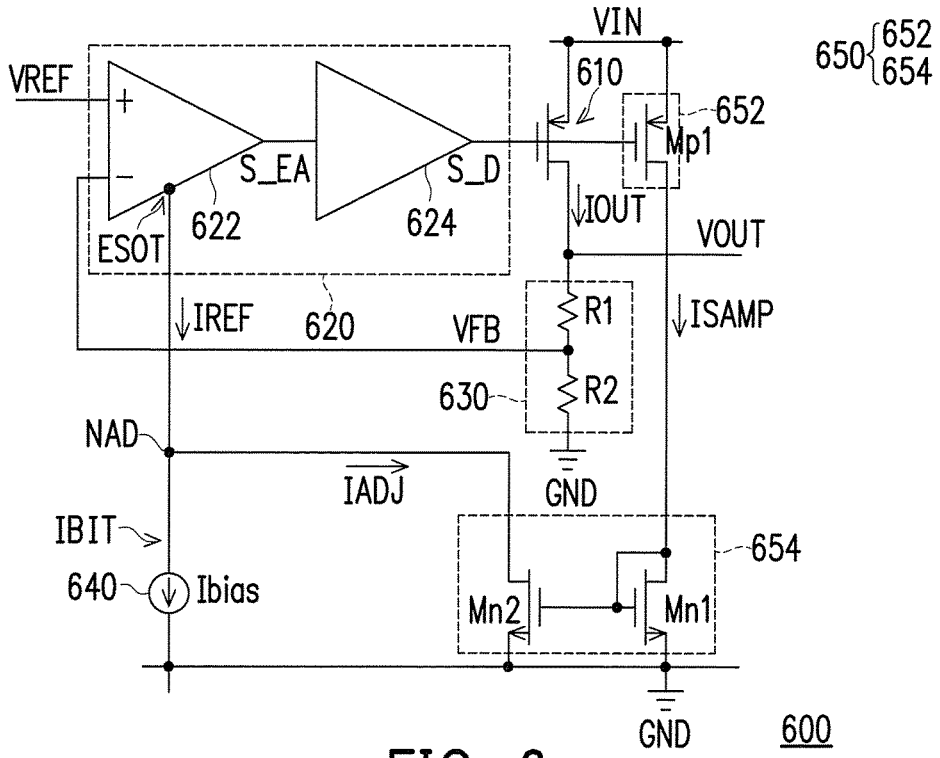
FIG. 6 is a schematic structural diagram illustrating an LDO according to the fifth embodiment of the invention.

FIG. 6 is a schematic structural diagram illustrating an LDO according to the fifth embodiment of the invention. Referring to FIG. 6, in the present embodiment, an LDO 600 includes a power transistor 610, a driving stage circuit 620, a feedback circuit 630, a bias power source 640 and an auxiliary reference current generation circuit 650. The driving stage circuit 620 includes an error amplifier 622 and an output buffer 624. The feedback circuit 630 includes the resistors R1 and R2. The auxiliary reference current generation circuit 650 includes a sampling unit 652 and a current mirror 654.

The power transistor 610 of the present embodiment is a P-type transistor. A gate of the power transistor 610 is coupled to an output terminal of the output buffer 624. A source of the power transistor 610 receives the input voltage VIN, and a drain of the power transistor 610 is coupled to a load (which is not shown, but may be, for example, the load LD) to provide the output voltage VOUT.

In the driving stage circuit 620, a positive input terminal of the error amplifier 622 receives the reference voltage VREF, and a negative input terminal of the error amplifier 622 is coupled to the feedback circuit 630 to receive the feedback voltage VFB. The error amplifier 622 compares the reference voltage VREF with the feedback voltage VFB and generates the error amplification signal S_EA according to the comparison result. An input terminal of the output buffer 624 is coupled to an output terminal of the error amplifier 622. The output terminal of the output buffer 624 generates the driving signal S_D according to the error amplification signal S_EA output by the error amplifier 622 and provides the driving signal S_D to the gate of the gate of the power transistor 610.

The feedback circuit 630 may be implemented by using the resistors R1 and R2 connected in serial. A first terminal of the resistor R1 is coupled to the drain of the power transistor 610, a second terminal of the resistor R1 is coupled to a first terminal of the resistor R2, and a second terminal of the resistor R2 is coupled to the negative power supply voltage (represented by the ground terminal GND in this case). Besides, a common node/voltage-dividing node between the resistors R1 and R2 is coupled to the negative input terminal of the error amplifier 622 to provide the feedback voltage VFB.

In the auxiliary reference current generation circuit 650, the sampling unit 652 may be implemented by using, for example, a P-type transistor Mp1, while the current mirror 654 may be implemented by using, for example, N-type transistors Mn1 and Mn2, but the invention is not limited thereto. A gate of the P-type transistor Mp1 is coupled to the gate of the power transistor 610, and a source of the P-type transistor Mp1 receives the input voltage VIN. A gate and a drain of the N-type transistor Mn1 are jointly coupled to a drain of the P-type transistor Mp1, and the source of the N-type transistor Mn1 is coupled to the negative power supply voltage (represented by the ground terminal GND in this case). A gate of the N-type transistor Mn2 is coupled to the gate of the N-type transistor Mn1. A drain of the N-type transistor Mn2 is coupled to an inflow end IBIT of the bias current of the bias power source 640 and an outflow end ESOT of the reference current of the error amplifier 622, and a source of the N-type transistor Mn2 is coupled to the negative power supply voltage (represented by the ground terminal GND in this case).

In detail, in the configuration of the P-type transistor Mp1, the P-type transistor Mp1 and the power transistor 610 have the same source-gate voltage (Vsg), and thus, a drain-source current (Ids) created between the P-type transistor Mp1 and the power transistor 610 is proportional to a size (W/L) of the transistor. In other words, In other words, as long as the size of the P-type transistor Mp1 is adaptively selected, the output current IOUT may be sampled in a ratio associated with the transistor size, so as to generate the sampling current ISAMP.

On the other hand, in the current mirror 654, the sampling current ISAMP flowing through the N-type transistor Mn1 is mapped to a current path of the N-type transistor Mn2 的 sampling current ISAMP according to a fixed ratio (which is determined according to the sizes of the N-type transistors Mn1 and Mn) to serve as the adjustment current IADJ. The reference current IREF is divided into the bias current Ibias and the adjustment current IADJ at the node NAD, and thus, the reference current IREF is equivalent to a sum of the bias current Ibias and the adjustment current IADJ and serves as a source current of the error amplifier 622 to output from an outflow end ESOT of the reference current of the error amplifier 622.

Thus, in the present embodiment, drive capability of the error amplifier 622 is adjusted with the size of the reference current IREF, and drive capability of the output buffer 624 maintains fixed.

Figure 7:
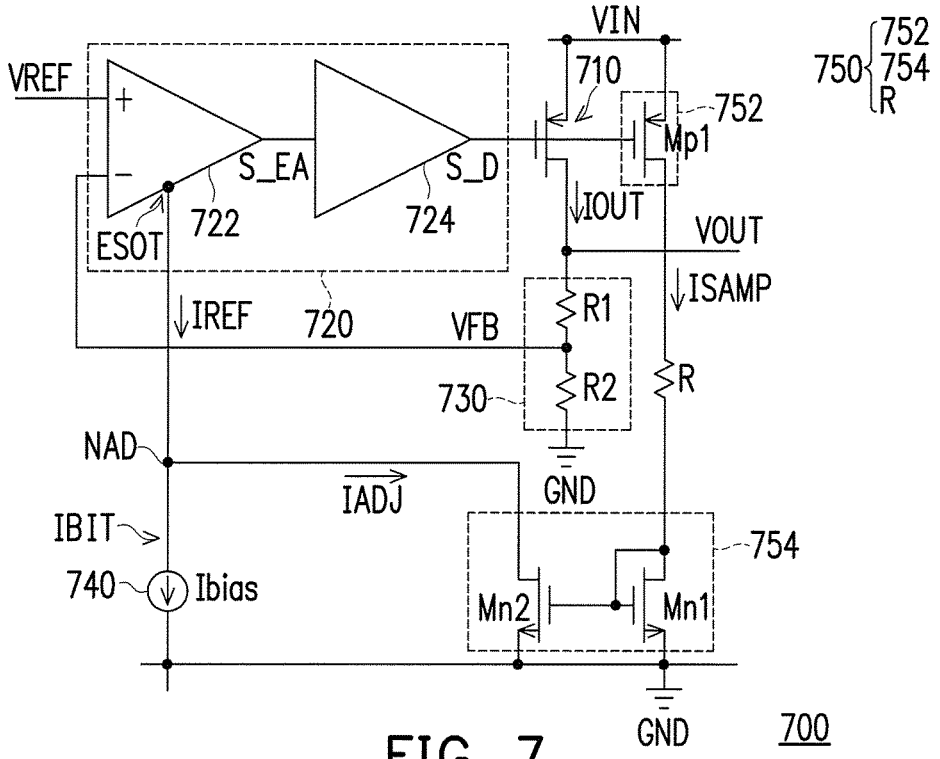
FIG. 7 is a schematic structural diagram illustrating an LDO according to the sixth embodiment of the invention.

FIG. 7 is a schematic structural diagram illustrating an LDO according to the sixth embodiment of the invention. Referring to FIG. 7, in the present embodiment, an LDO 700 includes a power transistor 710, a driving stage circuit 720, a feedback circuit 730, a bias power source 740 and an auxiliary reference current generation circuit 750. The driving stage circuit 720 includes an error amplifier 722 and an output buffer 724. The feedback circuit 730 includes the resistors R1 and R2. The auxiliary reference current generation circuit 750 includes a sampling unit 752, a current mirror 754 and the resistor R.

The circuit structure and the operation of the LDO 700 of the sixth embodiment are substantially the same as the LDO 600 of the fifth embodiment, and the difference therebetween lies in the auxiliary reference current generation circuit 750 of the present embodiment further including the resistor R. In detail, the resistor R is connected in serial between the P-type transistor Mp1 of the sampling unit 752 and the N-type transistor Mn1 forming the current mirror 754 and configured to decay/limit the size of the sampling current ISAMP, such that when the output current IOUT is too large, unnecessary power waste due to the adjustment current IADJ with an overly large size superposed on the bias current Ibias can be prevented.

Figure 8:
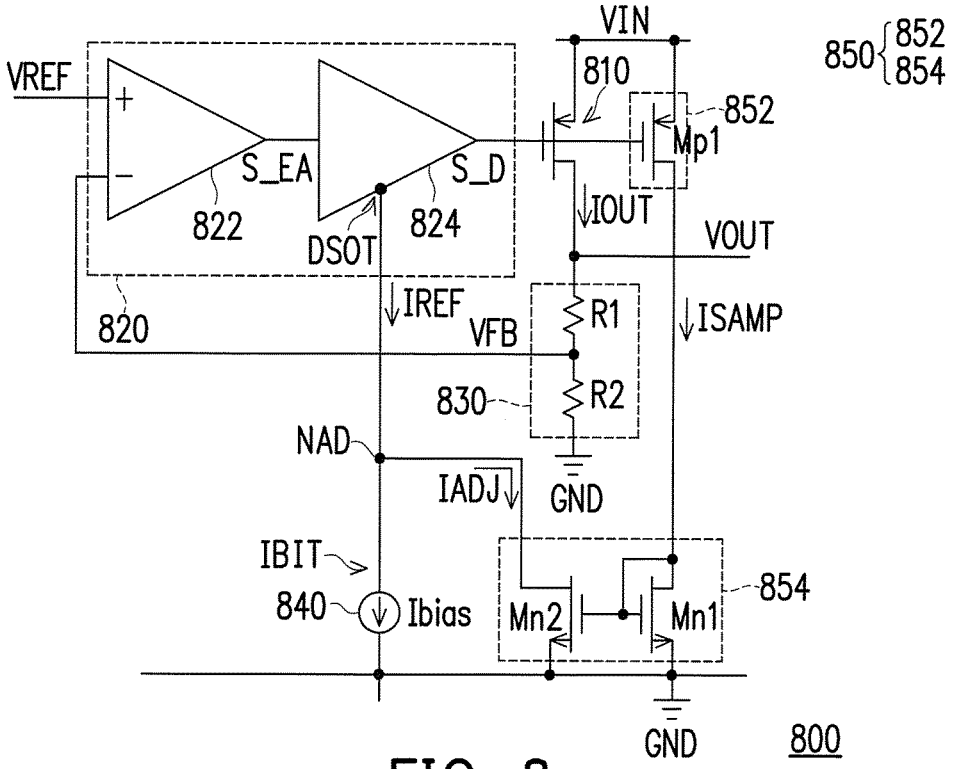
FIG. 8 is a schematic structural diagram illustrating an LDO according to the seventh embodiment of the invention.

FIG. 8 is a schematic structural diagram illustrating an LDO according to the seventh embodiment of the invention. Referring to FIG. 8, in the present embodiment, an LDO 800 includes a power transistor 810, a driving stage circuit 820, a feedback circuit 830, a bias power source 840 and an auxiliary reference current generation circuit 850. The driving stage circuit 820 includes an error amplifier 822 and an output buffer 824. The feedback circuit 830 includes the resistors R1 and R2. The auxiliary reference current generation circuit 850 includes a sampling unit 852 and a current mirror 854. The circuit structure of the LDO 800 of the seventh embodiment is substantially the same as the LDO 600 of the fifth embodiment, and the difference therebetween lies in the auxiliary reference current generation circuit 850 of the present embodiment provides the reference current IREF to the output buffer 824, so as to adjust drive capability of the output buffer 824.

In detail, the gate of the P-type transistor Mp1 is coupled to a gate of the power transistor 810, and a source of the P-type transistor Mp1 receives the input voltage VIN. A gate and a drain of the N-type transistor Mn1 are jointly coupled to the drain of the P-type transistor Mp1, and the source of the N-type transistor Mn1 is coupled to the ground terminal GND. The gate of the N-type transistor Mn2 is coupled to the gate of the N-type transistor Mn1. The drain of the N-type transistor Mn2 is coupled to bias power source 840 an inflow end IBIT of the bias current and an outflow end DSOT of the reference current of the output buffer 824, and the source of the N-type transistor Mn2 is coupled to the ground terminal GND.

In the current mirror 854 the sampling current ISAMP flowing through the N-type transistor Mn1 is mapped to the current path of the N-type transistor Mn2 according to the fixed ratio to serve as the adjustment current IADJ. The reference current IREF is divided into the bias current Ibias and the adjustment current IADJ at the node NAD, and thus, the reference current IREF is equivalent to the sum of the bias current Ibias and the adjustment current IADJ and serves as a source current of the output buffer 824 to output from an outflow end DSOT of the reference current of the output buffer 824.

Thus, in the present embodiment, the drive capability of output buffer 824 is adjusted with the size of the reference current IREF, and drive capability of the error amplifier 822 maintains fixed.

Figure 9:
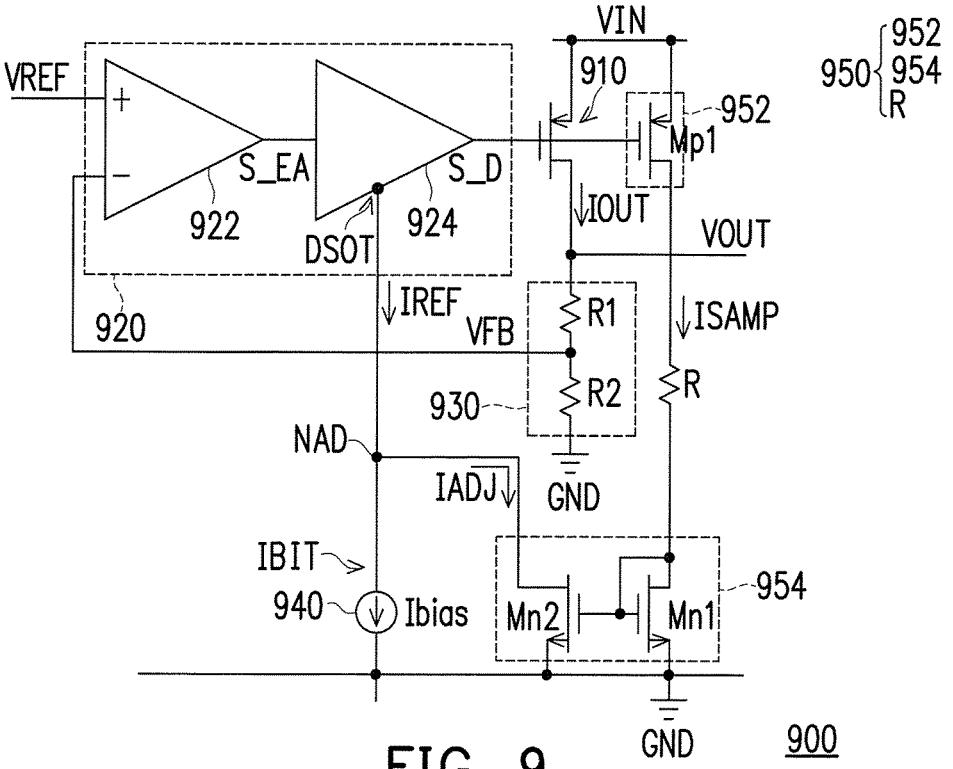
FIG. 9 is a schematic structural diagram illustrating an LDO according to the eighth embodiment of the invention.

FIG. 9 is a schematic structural diagram illustrating an LDO according to the eighth embodiment of the invention. Referring to FIG. 9, in the present embodiment, an LDO 900 includes a power transistor 910, a driving stage circuit 920, a feedback circuit 930, a bias power source 940 and an auxiliary reference current generation circuit 950. The driving stage circuit 920 includes an error amplifier 922 and an output buffer 924. The feedback circuit 930 includes the resistors R1 and R2. The auxiliary reference current generation circuit 950 includes a sampling unit 952, a current mirror 954 and the resistor R.

The circuit structure and the operation of the LDO 900 of the eighth embodiment are substantially the same as the LDO 800 of the seventh embodiment, and the difference therebetween lies in auxiliary reference current generation circuit 950 of the present embodiment further including the resistor R. In detail, the resistor R is connected in serial between the P-type transistor Mp1 forming the sampling unit 952 and the N-type transistor Mn1 forming the current mirror 954 and configured to decay/limit the size of the sampling current ISAMP, such that when the output current IOUT is too large, unnecessary power waste due to the adjustment current IADJ with an overly large size superposed on the bias current Ibias can be prevented.

To sum up, the invention provides an LDO capable of sampling the output current and superposing the adjustment current associated with the size of the output current to a fixed bias current by means of the mapping of the current mirror, which serves as the reference current for controlling the drive capability of the driving stage circuit. In this way, the LDO of the invention can dynamically and correspondingly adjust the drive capability of the driving stage circuit according to the size of the output current, such that the LDO can have advantages of low static power consumption and better load transient response characteristics.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A low-dropout voltage regulator (LDO), comprising:

a power transistor, receiving a driving signal, controlled by the driving signal for switching and converting an input voltage into an output voltage to provide to a load;

a feedback circuit, coupled to the power transistor and generating a feedback voltage according to the output voltage;

a driving stage circuit, generating the driving signal according to the feedback voltage and the reference voltage;

a bias power source, coupled to the driving stage circuit and configured to provide a bias current; and an auxiliary reference current generation circuit, coupled to the power transistor, the driving stage circuit and the bias power source and configured to sample an output current flowing through the power transistor, adjust the sampled output current to generate an adjustment current by means of mapping and superpose the adjustment current onto the bias current to generate a reference current to control drive capability of the driving stage circuit.

2. The LDO according to claim 1, wherein the driving stage circuit comprises:

an error amplifier, having a first input terminal receiving the reference voltage and a second input terminal receiving the feedback voltage; and an output buffer, having an input terminal coupled to an output terminal of the error amplifier and an output terminal coupled to the power transistor to provide the driving signal.

3. The LDO according to claim 2, wherein the auxiliary reference current generation circuit comprises:

a sampling unit, coupled to the power transistor and configured to sample the output current, so as to generate a sampling current; and a current mirror, coupled to the sampling unit, adjusting the sampling current as the adjustment current by means of mapping, superposing the adjustment current onto the bias current provided by the bias power source and generating the reference current to be provided to one of the error amplifier and the output buffer.

4. The LDO according to claim 3, wherein the power transistor is an N-type transistor having a gate coupled to the output terminal of the output buffer, a drain receiving the input voltage and a source coupled to the load, and the sampling unit is a first N-type transistor having a gate coupled to the gate of the power transistor and a source coupled to the source of the power transistor.

5. The LDO according to claim 4, wherein the current mirror comprises:

a first P-type transistor, having a gate and a drain jointly coupled to the drain of the first N-type transistor and a source receiving a positive power supply voltage; and a second P-type transistor, having a gate coupled to the gate of the first P-type transistor, a drain coupled to an outflow end of the bias current of the bias power source and an inflow end of the reference current of the error amplifier and a source receiving the positive power supply voltage.

6. The LDO according to claim 5, wherein the auxiliary reference current generation circuit further comprises:

a resistor, connected in serial between the drain of the first N-type transistor and the drain of the first P-type transistor.

7. The LDO according to claim 4, wherein the current mirror comprises:

a first P-type transistor, having a gate and a drain jointly coupled to the drain of the first N-type transistor and a source receiving a positive power supply voltage; and a second P-type transistor, having a gate coupled to the gate of the first P-type transistor, a drain coupled to an outflow end of the bias current of the bias power source and an inflow end of the reference current of the error amplifier and a source receiving the positive power supply voltage.

8. The LDO according to claim 7, wherein the auxiliary reference current generation circuit further comprises:

a resistor, connected in serial between the drain of the first N-type transistor and the drain of the first P-type transistor.

9. The LDO according to claim 3, wherein the power transistor is a P-type transistor having a gate coupled to the output terminal of the output buffer, a source receiving the input voltage and a drain coupled to the load, and the sampling unit is a first P-type transistor having a gate coupled to the gate of the power transistor and a source receiving the input voltage.

10. The LDO according to claim 9, wherein the current mirror comprises:

a first N-type transistor, having a gate and a drain jointly coupled to the drain of the first P-type transistor and a source coupled to a negative power supply voltage; and a second N-type transistor, having a gate coupled to the gate of the first N-type transistor, a drain coupled to an inflow end of the bias current of the bias power source and an outflow end of the reference current of the error amplifier and a source coupled to the negative power supply voltage.

11. The LDO according to claim 10, wherein the auxiliary reference current generation circuit further comprises:

a resistor, connected in serial between the drain of the first P-type transistor and the drain of the first N-type transistor.

12. The LDO according to claim 9, wherein the current mirror comprises:

a first N-type transistor, having a gate and a drain jointly coupled to the drain of the first P-type transistor and a source coupled to a negative power supply voltage; and a second N-type transistor, having a gate coupled to the gate of the first N-type transistor, a drain coupled to an inflow end of the bias current of the bias power source and an outflow end of the reference current from the output buffer and a source coupled to the negative power supply voltage.

13. The LDO according to claim 12, wherein the auxiliary reference current generation circuit further comprises:

a resistor, connected in serial between the drain of the first P-type transistor and the drain of the first N-type transistor.

* * * * *